United States Patent [19]

Charwat

[11] Patent Number: 4,994,657

[45] Date of Patent: Feb. 19, 1991

[54] ESTATE AND GIFT TAX ESTIMATOR

[76] Inventor: Mark S. Charwat, 19 Estate Dr., Jericho, N.Y. 11753

[21] Appl. No.: 408,138

[22] Filed: Sep. 15, 1989

[51] Int. Cl.[5] ..... G06G 1/02

[52] U.S. Cl. ..... 235/70 R; 235/89 R

[58] Field of Search ..... 235/70 R, 78 F, 88 F, 235/89 R

[56] References Cited

U.S. PATENT DOCUMENTS

| | | | |
|---|---|---|---|
| 2,532,619 | 12/1950 | Heerich | 235/70 R X |
| 2,746,682 | 5/1956 | Zak | 235/70 R |
| 3,045,908 | 7/1962 | Donovan | 235/70 R |
| 3,747,847 | 7/1973 | Cohen | 235/85 R |
| 3,933,305 | 1/1976 | Murphy | 235/70 A |
| 4,132,348 | 1/1979 | Bromberg | 235/70 R X |
| 4,324,975 | 4/1982 | Rees | 235/70 A |

*Primary Examiner*—Benjamin R. Fuller

*Attorney, Agent, or Firm*—Scully, Scott, Murphy & Presser

[57] ABSTRACT

An estate and gift tax estimator having a two-sided pocket part consisting of separate layers of semi-rigid material, whereby each layer is provided with a series of windows for viewing an insert card which is slideably engaged between the two layers defining the pocket. The insert card has a series of columns of numerical data corresponding in location to the windows on the outer layers, such that at least one column corresponds to taxable assets and the other column is a calculation of the estate tax applicable to that amount of taxable assets thereby allowing for the estimation of taxes between the calculated levels. The columns are adjacent to each other such that when a number corresponding to a taxable asset appears in a window, the corresponding estate tax estimate appears in the adjacent window. The insert card is interchangeable and may be oriented in any manner in the pocket part while providing accurate estimations of the estate tax.

8 Claims, 2 Drawing Sheets

ESTATE AND GIFT TAX ESTIMATOR

BACKGROUND OF THE INVENTION

1. Field of the Invention

The present invention relates to slide rule calculators, and more particularly, to a slide rule estimator having a pocket type cover and an insert card which allows for estimation of estate and gift tax corresponding to one's taxable assets for a broad range of asset figures.

Slide rule calculators having an insert card enclosed within a pocket type cover employing several windows for viewing numbers or calculations are well known in the art. These devices generally are bulky and inconvenient to carry due to their size. Moreover, they generally tend to calculate rather than estimate various figures ranging from taxes to personal data such as assets and net worth, requiring a large amount of comparative data necessary to provide accurate calculations, which consequently leads to a large and bulky calculator. Alternatively, smaller calculators may be available, but will have too large a range between calculations to accomodate the small size. Many of these devices employ one or more insert cards, or in an effort to reduce the size of the device employ a print font of a very small size, which often proves difficult to read. Many are single-sided, and those that are double-sided, generally require the insert card to correspond to one particular side of the calculator. Inserting the card in a backwards position, would result in inaccurate calculations, or inserting in an upside down position would result in the numbers failing to line up with their corresponding windows, making the device useless.

2. Discussion of the Prior Art

In the prior art, various types of slide rule calculators are disclosed, which reflect the various types of data to be calculated. These various devices, however, are subject to several disadvantages which, in many cases, inconvenience the user, and in some cases, require careful and specialized reading of the data to be calculated, since the device carries highly specialized numerical data.

Rees, U.S. Patent No. 4,324,975, discloses a hand held calculating device for calculating federal income taxes and various other tax information. The device comprises two sides secured together with a pocket therebetween, and each side is provided with a plurality of windows for calculating various tax numbers. An insert card is provided which slides up and down to reveal various numbers corresponding to various tax calculations. This device however, is a complicated device requiring precise input data to calculate the correct tax. In addition, the insert card must be properly fitted into the slot between the two outer layers and the card must be aligned with the proper side facing in a proper direction since the windows do not line up from one side to the other. Consequently, putting the insert card in backwards would either result in the numbers being only partially revealed, or worse, the calculation would be incorrect.

Murphy, U.S. Patent No. 3,933,305, discloses an asset value calculator, which comprises a two layer hand held calculator having a number of insert strips which are housed in the pocket between the two layers. Various windows are provided on one side of the outer layer, such that the strips align themselves with each other inside the pocket, and data along the bottom edge of one corresponds to data on the top edge of another.

This device suffers similar disadvantages to the Rees device, as described above, and it is apparent that misaligning the insert strips will present inaccurate data, and presenting the wrong side of an insert strip at a window will reveal no data.

Bromberg, U.S. Patent No. 4,132,348, discloses a slide calculator having a single sheet construction which is detachable from itself and reassembled by a user to form a pocket and insert card. The piece forming the pocket part comprises a foldable sheet such that two sides are formed with a large window and a small window on each side. The second piece is foldable to form the insert card which is provided with a plurality of numbers on either side. The insert card is placed between the two sides of the pocket part, but must be placed in a specific configuration so that the numbers align with the windows. It is apparent that this device also suffers from the disadvantage that if the insert card is improperly positioned, the numerical data will either be inaccurate or will not be revealed to the user.

The novel slide estimator pursuant to the present invention obviates the disadvantage of the prior art and provides an accurate and easy-to-use tax estimator which eliminates the risk of inaccurate or incorrect calculation of the numerical data through the estimation of data, rather than precise calculation. A range of taxable asset levels are provided with the corresponding tax level, which is an accurate calculated tax for that particular asset. The device of the present invention allows for the accurate and fast estimation of taxes between asset levels provided for on the device.

The device has two sides forming a pocket with each side having at least two windows located an equal distance from each side edge that forms a length side of the device. The windows on the front side correspond in location to the windows on the back side and also correspond in size. An insert card is provided with columns of numbers on the front and on the back which correspond to the number of windows provided on the respective sides of the pocket part. The columns on the front also correspond in location to the columns of numbers on the back, thereby allowing the card to be inserted in any manner so that the numbers always align with the windows and are easily read by a user. The columns of numbers on the insert card always align with the windows on the front and back of the device so that the numerical data may always be accurately estimated regardless of how the insert card is positioned in the pocket part.

SUMMARY OF THE INVENTION

The present invention eliminates or substantially ameliorates the disadvantages encountered in the prior art through the provision of a hand-held slide estimate for estimating numerical data such as estate and gift taxes on both the federal and state level. The present device provides for fast and accurate reference to tax figures for various taxable asset levels which are precisely calculated for an accurate representation of the tax required for that asset level. The novel device of this invention allows the user to estimate, rather than calculate, the taxes between asset levels in an effort to provide a quick and easy to use reference for accountants, attorneys, or those who wish to have this information readily available without the necessity for detailed calculations.

The estimator device of the present invention is different from a calculator in that a calculator allows for the exact calculation of taxes at all levels. For example, a calculator permits the calculation of estate taxes on taxable assets of $957,632.57. In order to do so, the calculator would indicate the federal estate tax base and it would also indicate the tax bracket of assets in excess of the base. There would have to be similar calculations with respect to the state estate tax. Also, a calculate or would also have to take into consideration the federal estate state surcharge, the federal estate death tax credit, etc. Thus, to calculate the total of federal and state estate taxes for any amount of taxable assets might require as many as twenty separate calculations, which of course would be a very tedious and time consuming project.

The estimator device of the present invention is exact and precise at the levels indicated. For example, the total taxes on $800,000 of taxable assets is $90,700, and the total taxes on $900,000 of taxable assets is $131,900. However, the Estimator does not allow the calculation of an exact tax on taxable assets between $800,000 and $900,000. However, such taxes may be easily "estimated". For example, if one desired to estimate the total of Federal and New York estate taxes on $850,000 of estate taxes, then one might add the $90,700 to the $131,900 and divide the total by two. Such estimate would not be exact, but it would be very close and easily fulfill the needs of persons wishing to obtain a quick estimate of total taxes and avoid the complications involved in actually calculating the total of such taxes. Furthermore, in estate planning exact figures are often not required nor even desired. In estate planning round numbered estimates are more desirable since a person's assets are changing daily and since round numbers are more easily understood and remembered. Also, the objective is not to determine with exact precision the amount of the person's assets and the amount of estate taxes applicable thereto. In estate planning, there are simply too many variables to justify the time and expenses involved in detailed, lengthy and exact calculations. For example, the person may be in good health, and while he might wish to estimate his estate taxes, he is not contemplating his immediate death. Moreover, estate expenses such as legal fees and executor's fees are not known. Thus, the many variables do not justify the lengthy time and effort involved in precise calculations, especially where a reasonably accurate estimate can be obtained almost instantly by use of this device.

The construction of the device allows for highly accurate and essentially error free use due to the symmetrical nature of the construction of the device. The device is lightweight, and pocket-sized, so that it may easily be carried either in a briefcase or on the user's person. The estimator of the present invention comprises a two-sided insert card which slides into a pocket part consisting of a front layer and a back layer, whereby the width of the pocket part is slightly greater than the width of the insert card, and the length of the pocket part is slightly less than the length of the insert card. The pocket part is provided with a number of windows on the front layer and a corresponding number of windows on the back layer. Preferably, there are two windows provided on the front layer and two windows provided on the back layer; these windows being located symmetrically in relation to the edge of the pocket part comprising the length edge so that the distance from the first window to its respective length edge is equal to the distance of the second window to its respective length edge. The windows on the front layer are symmetrical to the windows on the back layer, such that the windows are spaced equally from each other as well from the side edges comprising the length of the device The insert card is provided with a plurality of columns of numbers, and the exact number of columns corresponds to the number of windows provided on each side of the pocket part. Therefore, if two windows are provided on the front layer of the pocket part, two windows are provided on the back layer of the pocket part, and the insert card will have two columns of numerical data on one side and two columns of numerical data on the opposite side. The columns on the insert card are also symmetrical, such that the columns on one side of the insert card correspond in location to the columns on the second side and further correspond in location to the windows on the outer layers so that the numbers are revealed through the windows when the insert card is in the pocket part. Accordingly, the insert card may then be inserted into the pocket part in any manner, thus insuring that numerical data will be read correctly regardless of the manner in which the insert card is placed into the pocket part. This eliminates the risk of inaccurate data, by insuring that the windows align with the columns at all times to provide an accurate reading regardless of the direction of insertion of the insert card.

Accordingly, it is an object of the present invention to provide an efficient and accurate hand held slide estimator for estimating numerical data such as taxes.

It is a further object of the invention to provide a two sided estimator having an interchangeable insert card which estimates numerical data regardless of the orientation of the insert card within the estimator pocket.

It is still a further object of the invention to provide an easy to understand and use hand held slide estimator for estimating numerical data such as estate and gift taxes.

BRIEF DESCRIPTION OF THE DRAWINGS

The foregoing objects and other features of the invention will become more readily apparent and may be understood by referring to the following detailed description of an illustrated embodiment of the estate and gift tax estimator, taken in conjunction with the accompanying drawings, in which.

DETAILED DESCRIPTION OF THE PREFERRED EMBODIMENTS

Figure 1:
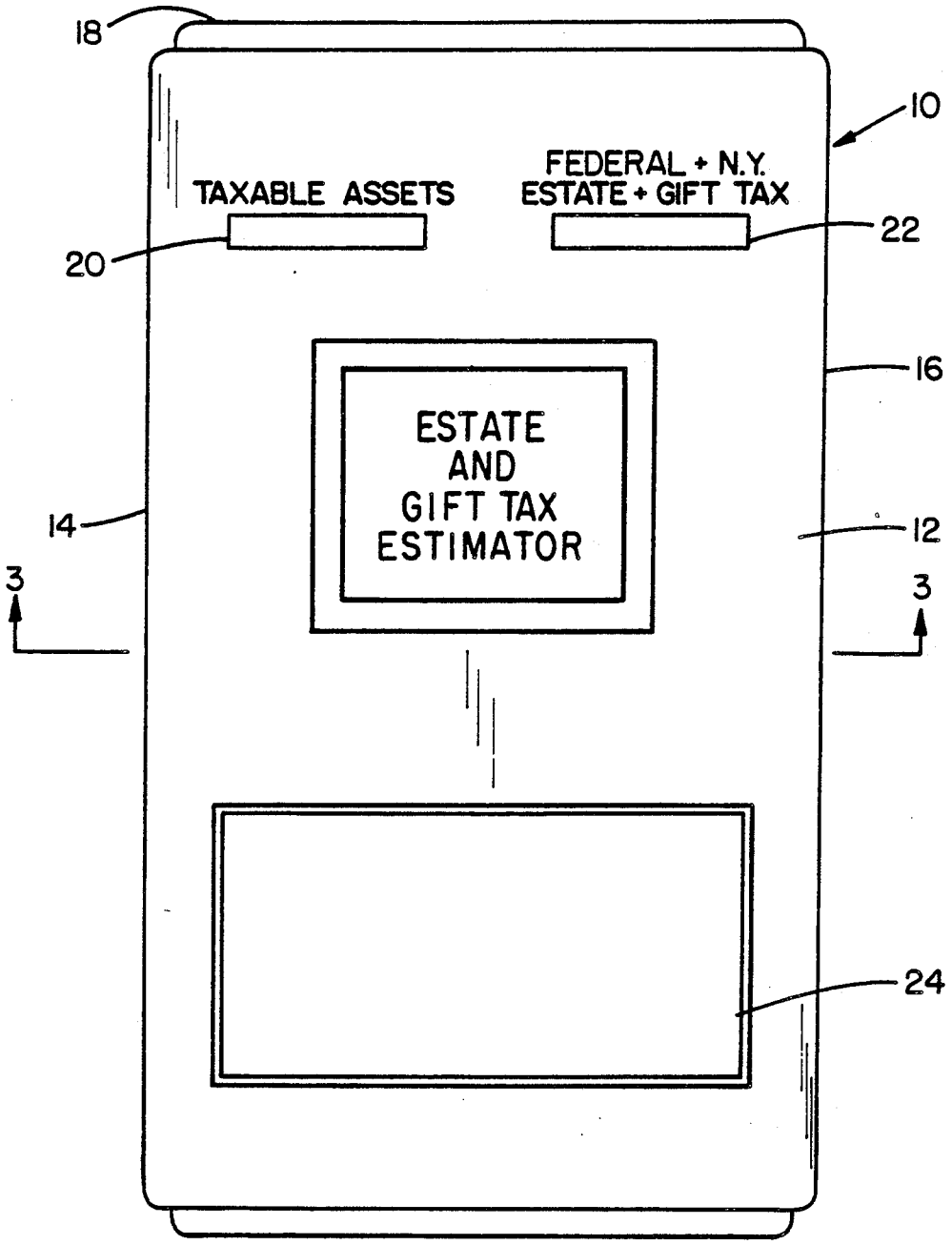
FIG. 1 illustrates an elevation of the front side of a preferred embodiment of the estimator pursuant to the present invention.
Figure 2:
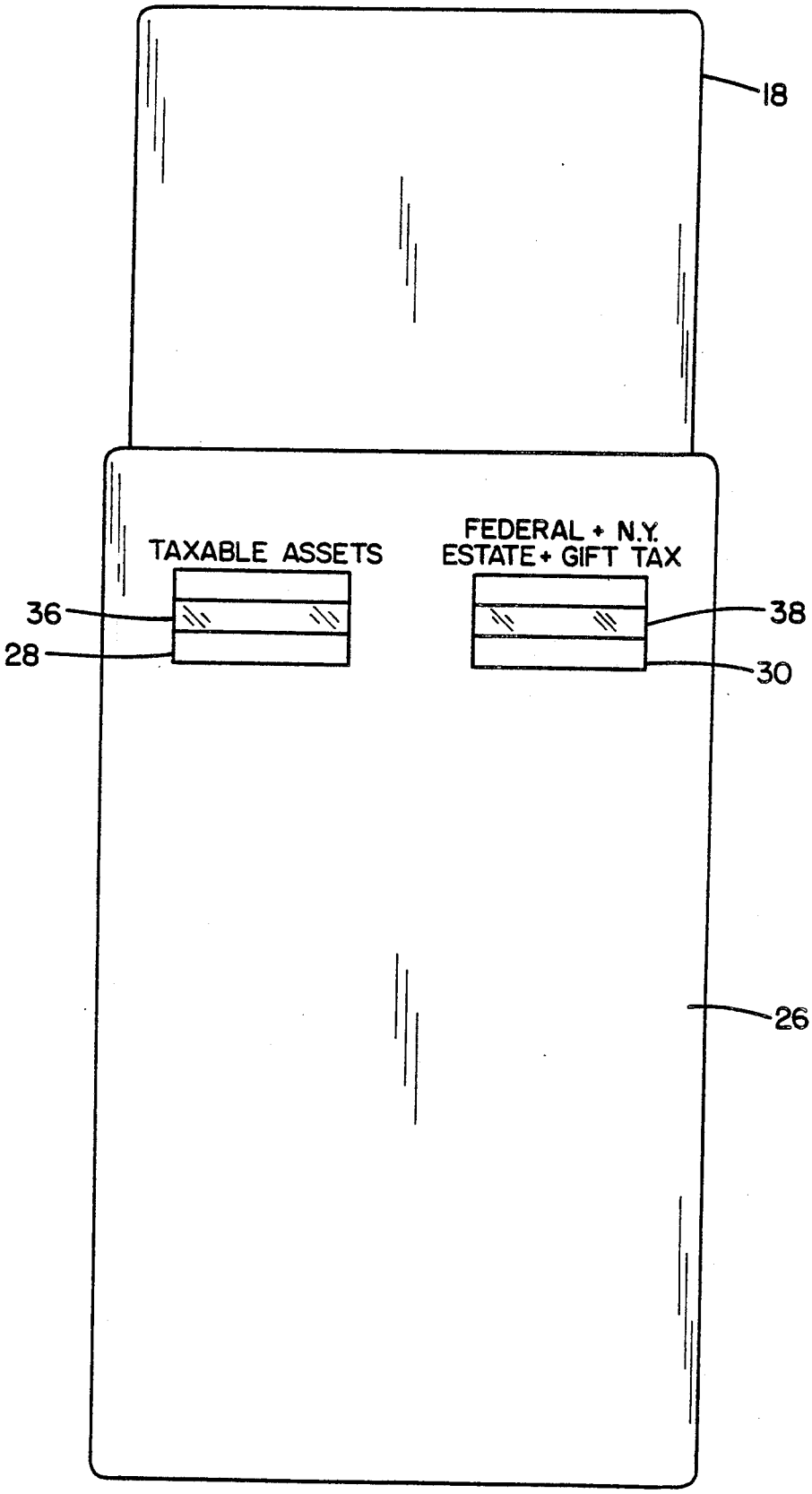
FIG. 2 illustrates an elevation of the back side of the estimator shown in FIG. 1 showing the alternate windows.

Referring now in specific detail to the drawings, in which identical reference numerals identify similar or identical elements throughout the several views, FIGS. 1 and 2 show front and back views, respectively, of a preferred embodiment of the estimator with an insert card located in the pocket according to the present invention. The estimator, as generally indicated at 10, preferably comprises a single sheet of pliable, yet semi-rigid material, such as cardboard, multi-plied paper, or soft plastic. The estimator 10 is generally rectangularly shaped and forms a front face 12 and back face 26. Front face 12 is folded at a lengthwise edge 14 and wraps around to form back face 26, which is secured to front face 12 along lengthwise edge 16, preferably by glue, tape, plastic or the like. If the construction material of the estimator 10 is plastic, lengthwise edges 14 and 16 may be an epoxy seal or a heat seal, such that front face 12 and back face 26 are constructed of two identical but separate sheets of plastic material.

Figure 3:
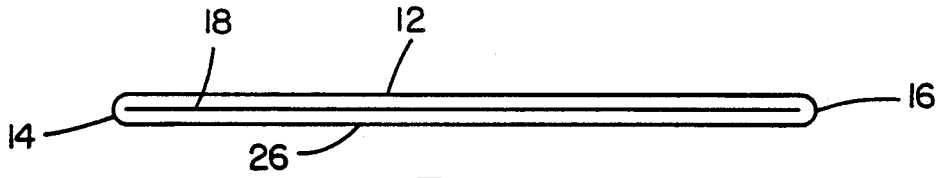
FIG. 3 illustrates a side elevation view taken along line 3—3 of FIG. 1.

Insert card 18 is also rectangularly shaped, and has a width slightly less than the width of front face 12 and has a length slightly greater than the length of front face 12. This allows for a gripping area to extend outside of the estimator so that insert card 18 may be gripped to be moved freely within the pocket formed by front face 12 and back face 26. The lesser width is necessary to ensure a free sliding engagement between the card and the pocket, as best seen in FIG. 3.

Front face 12 is provided with a number of cut out portions or windows for viewing insert card 18 through front face 12. Preferably, two windows are provided as at 20 and 22, which are identical in size and located directly opposite and adjacent each other along a longitudinal vertical axis of estimator 10. Each window is located an identical distance from side edge 14 and 16 respectively. In addition, a pocket 24 may be provided on front face 12, for holding items such as business cards or scratch paper. As best seen in FIG. 2, back face 26 is likewise provided with windows 28 and 30 which may be positioned at a point identical to windows 20 and 22 on front face 12. Windows 28 and 30 are also located a similar distance from edge 14 and 16, respectively.

Insert card 18 is provided with a number of columns representing numerical data, generally as indicated at 32 and 34. These columns are provided on both sides of insert card 18 such that the estimator 10 may be used on either side. The numerical data generally increases starting from a lowest number at the top to a greatest number at the bottom. Generally, column 32 corresponds to taxable assets and column 34 corresponds to the estate taxes and gift taxes that would be applicable to the taxable asset listed next to it in column 32. On the reverse side of insert card 18 are a similar set of columns of numerical data arranged in a similar fashion with taxable assets in one column and estate taxes in the second column. The columns are so arranged that insert card 18 may be inserted into the estimator 10 in any orientation, so that taxable assets in one column and estate taxes in the other column are viewable through the windows in proper alignment, thereby insuring accurate estimation of the taxes in relation to a particular taxable asset.

Windows 20, 22, 28 and 30 are preferably dimensioned to reveal a single number at each window. Alternatively, as shown in FIG. 2, the window may be sized to reveal several numbers in the column, such as three in succession, whereby a range is thus provided. In such a case, it is desirably to provide a clear but colored strip of plastic to highlight the middle number of the three revealed.

The estate and gift tax estimator of the present invention is an accurate and easy to use device for estimating estate tax on the federal and state level for various levels of taxable assets based on accurate calculations for a range of taxable assets. Variations on the embodiment described above are contemplated and may include innovations such as the location of the windows, provided they are located at corresponding levels regarding taxable assets and taxes, as well as variations in the length and width of the estimator.

While the invention has been particularly shown and described with reference to the preferred embodiment, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. A device for estimating estate and gift taxes comprising:

a front cover substantially rectangular in shape having two sides forming a width and two sides forming a length of said device, said two sides forming said length being longer than said two sides forming said width, a back cover substantially identical in length and width as said front cover, and attached to said front cover along said two sides forming said length, said front cover spaced from said back cover such that said device forms a pocket open at a top and bottom as defined by said two sides forming said width, an insert card having a front and back and having a length slightly greater than the length of said front and back covers and a width slightly less than the width of said covers, said insert card slidably mounted in said pocket formed between said front and back covers, wherein said front and back covers are each provided with at least two cutout forming windows adjacent to each other and corresponding in position to columns of numbers on said insert card, said columns of numbers being parallel to said sides forming the length of said covers and said insert card and being positioned a same distance from both of said length sides and both of said width sides, said columns further being located on both the front and back of said insert card, said columns of numbers on said insert card comprising two columns on each of said front and back of said insert card, one column on each of said front and back corresponding to taxable assets and one column on each of said front and back corresponding to estate and gift taxes, such that a taxable asset number is adjacent to a corresponding tax number for display in corresponding windows of said front and back covers.

2. A device according to claim 1, wherein said windows on said front cover correspond in position to said windows on said back cover.

3. A device according to claim 1, wherein said windows are rectangular in shape and are of such a size so as to expose at least one number of said column of numbers at a time.

4. A device according to claim 3, wherein said windows on said front and back covers simultaneously expose a number from each of said columns.

5. A device according to claim 1, wherein the number of windows is equal to the number of columns on said insert card.

6. A device according to claim 2, wherein said windows on said front cover and said back cover are adjacent each other along the length of said cover.

7. A device according to claim 3, wherein said windows are of a size so as to expose three numbers from each column at a time.

8. A device according to claim 7, wherein said windows are covered with a clear plastic said plastic having a colored or tinted stripe having a width sized to illuminate one number at a time.

* * * * *

UNITED STATES PATENT AND TRADEMARK OFFICE

CERTIFICATE OF CORRECTION

PATENT NO. : 4,994,657

DATED : February 19, 1991

INVENTOR(S) : Mark S. Charwat

It is certified that error appears in the above-identified patent and that said Letters Patent is hereby corrected as shown below:

Column 3, line 9: "calculate or" should read as --calculator--

Column 4, line 6: "device" should read as --device.--

Column 6, line 30, Claim 1: "cutout" should read as --cutouts--

Signed and Sealed this

Seventh Day of July, 1992

*Attest:*

DOUGLAS B. COMER

*Attesting Officer*

*Acting Commissioner of Patents and Trademarks*